US009653243B2

(12) United States Patent
Bachmaier et al.

(10) Patent No.: US 9,653,243 B2
(45) Date of Patent: May 16, 2017

(54) SEPARATING UNIT WITH ELECTROMAGNETIC DRIVE

(71) Applicant: SIEMENS AKTIENGESELLSCHAFT, Munich (DE)

(72) Inventors: Georg Bachmaier, Munich (DE); Andreas Goedecke, Munich (DE); Denis Imamovic, Nuremberg (DE); Sylvio Kosse, Erlangen (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 15/031,879

(22) PCT Filed: Oct. 25, 2013

(86) PCT No.: PCT/EP2013/072423
§ 371 (c)(1),
(2) Date: Apr. 25, 2016

(87) PCT Pub. No.: WO2015/058813
PCT Pub. Date: Apr. 30, 2015

(65) Prior Publication Data

US 2016/0268082 A1 Sep. 15, 2016

(51) Int. Cl.
*H01H 1/00* (2006.01)
*H01H 50/54* (2006.01)
(Continued)

(52) U.S. Cl.
CPC ..... *H01H 50/54* (2013.01); *H01H 1/02* (2013.01); *H01H 1/385* (2013.01);
(Continued)

(58) Field of Classification Search
CPC ..... H01H 50/14; H01H 50/54; H01H 50/60; H01H 50/546; H01H 50/023;
(Continued)

(56) References Cited

U.S. PATENT DOCUMENTS 4,221,942 A 9/1980 Hertz et al.
4,697,822 A * 10/1987 Blanz ..... B60G 17/0525 280/6.158
(Continued)

FOREIGN PATENT DOCUMENTS

DE 3142883 A1 5/1983
FR 1441239 A 4/1966
FR 2375710 A1 7/1978

OTHER PUBLICATIONS

Häfner et al, "Proactive Hybrid HVDC Breakers—A key innovation for reliable HVDC grids", Integrating super grids and micro grids International Symposium, 2011.
Meyer et al., "A DC Hybrid Circuit Breaker with Ultra-Fast Contact Opening and Integrated Gate-Commutated Thyristors (IGTs)", IEEE Transactions on Power Delivery, vol. 21, No. 2, 2006.

*Primary Examiner* — Shawki S Ismail
*Assistant Examiner* — Lisa Homza
(74) *Attorney, Agent, or Firm* — Laurence Greenberg; Werner Stemer; Ralph Locher

(57) ABSTRACT

A mechanical circuit breaker unit for interrupting a line includes a contact arrangement and an electromagnetic drive. The contact arrangement has first and second fixed contacts and a guided moving contact. The electromagnetic drive moves the moving contact. The separating unit can assume a first state and a second state. No electric connection exists between the first and second fixed contacts in the first state. The moving contact electrically connects the two fixed contacts to each other in the second state. The separating unit can be transferred from the second state into the first state by moving the moving contact. The second fixed contact has a recess for receiving the moving contact, and
(Continued)

the moving contact engages at least partly into the recess when the separating unit is in the first state.

13 Claims, 2 Drawing Sheets

(51) Int. Cl.
*H01H 1/02* (2006.01)
*H01H 1/38* (2006.01)
*H01H 33/28* (2006.01)
*H01H 50/02* (2006.01)

(52) U.S. Cl.
CPC ..... *H01H 33/285* (2013.01); *H01H 50/023* (2013.01); *H01H 2050/025* (2013.01); *H01H 2201/022* (2013.01)

(58) Field of Classification Search
CPC ..... H01H 2201/022; H01H 2050/025; H01H 1/20; H01H 73/045; H01H 2205/016–2205/03
USPC ..... 335/196
See application file for complete search history.

(56) References Cited

U.S. PATENT DOCUMENTS 6,404,314 B1 * 6/2002 Arnold ..... H01H 71/7463 335/176
8,912,871 B2 * 12/2014 Lauraire ..... H01H 3/28 218/120
2004/0099639 A1 * 5/2004 Valdermarsson ..... H01H 33/36 218/118
2008/0012664 A1 * 1/2008 DeBoer ..... H01H 51/2209 335/14
2008/0018422 A1 * 1/2008 Claeys ..... H01F 1/0308 335/35
2009/0237190 A1 * 9/2009 Nyzner ..... H01H 50/36 335/174
2010/0060392 A1 * 3/2010 Cho ..... H01H 50/023 335/124
2013/0327605 A1 * 12/2013 Bachmaier ..... B60T 13/10 188/361
2015/0048908 A1 * 2/2015 Isozaki ..... H01H 1/54 335/6
2016/0241166 A1 * 8/2016 Bachmaier ..... F16F 15/005

* cited by examiner

SEPARATING UNIT WITH ELECTROMAGNETIC DRIVE

BACKGROUND OF THE INVENTION

Field of the Invention

The invention relates to a circuit breaker unit for interrupting an electrical line, having a contact arrangement and having an electromagnetic drive means. The contact arrangement has a first and a second fixed contact and a guided moving contact, wherein, in this context, the expressions "contact" and "contact piece" are to be understood synonymously. The electromagnetic drive means is designed for moving the moving contact. The circuit breaker unit can assume a first state and a second state, wherein, in the first state, there is no electrical connection between the first and the second fixed contact, whereas in the second state, the moving contact electrically connects the two fixed contacts to one another. The circuit breaker unit can be transferred from the second state into the first state by movement of the moving contact.

Switching systems with the circuit breaker unit of said type are already known and generally serve, in medium-voltage and high-voltage technology, for the switching of currents, in particular short-circuit currents. They are used in particular in electrical energy supply networks, where short-circuit currents can lead firstly to a severing of the energy flow to the consumer and secondly to high mechanical loads of current-conducting network components.

In their article "Proactive Hybrid HVDC Breakers—A key innovation for reliable HVDC grids"; Integrating super grids and micro grids International Symposium, 2011, Häfner et al. describe a hybrid direct-current switching system in which the main path comprises a mechanical breaker switch and an electronic auxiliary switch. In the event of a short circuit, the rising short-circuit current is commutated by way of the auxiliary switch from the main path to a bypass path, wherein at the same time, the opening of the breaker switch is initiated. In the bypass path there is arranged a power switch unit which has a series circuit of electronic switches. If the breaker switch has reached the required dielectric strength, the short-circuit current can be interrupted by way of the power switch unit. The energy released in the process is dissipated in non-linear resistors of the power switch.

In known mechanical breaker switches of medium-voltage and high-voltage switching systems, spring store drives are normally used for the mechanical opening and closing of the contact system. The switching times that can be achieved here are limited to some 10 to 50 ms. For switching systems in high-voltage direct current transmission installations (HVDC), for example, such switching times are far too long, such that solutions with faster switching times are desirable.

The article "A DC Hybrid Circuit Breaker With Ultra-Fast Contact Opening and Integrated Gate-Commutated Thyristors (IGCTs)"; IEEE Transactions on Power Delivery, Vol. 21, No. 2, 2006 by J-M. Meyer et al. describes the mechanical circuit breaker unit of the type described in the introduction. The moving contact of the contact arrangement is in this case realized as a solid copper disk which is guided so as to be movable perpendicularly to the current flow direction. The electromagnetic drive means comprises a Thomson coil which is arranged coaxially with respect to the copper disk. Utilizing the Thomson effect, the moving contact can be moved, such that the breaker unit is transferred from the second state into the first state.

Proceeding from the prior art, it is the object of the present invention to propose an alternative circuit breaker unit of the type mentioned in the introduction.

BRIEF SUMMARY OF THE INVENTION

The object is achieved in that the second fixed contact of the contact arrangement has a recess for receiving the moving contact, and in that the moving contact engages at least partially into the recess when the circuit breaker unit is in the first state.

The circuit breaker unit according to the invention is more compact than the circuit breaker units hitherto known. Further advantages are the following: a very short reaction time, because the electromagnetic field exerts its action directly on the moving contact; very short movement times, because no additional mechanical parts have to be moved; simple control of the movement of the guided moving contact, including the acceleration and braking by way of the magnetic field; attainment of repeat rates with very short times between the two states of the circuit breaker unit; avoidance of additional masses in the arrangement. Furthermore, the electromagnetic drive can be actuated as often as desired, for example by contrast to explosion-type drives. Furthermore, owing to the electromagnetic drive, there is no need to allow for any insulation between parts conducting high voltage and a drive stator.

The recess of the second fixed contact is preferably designed for guiding the moving contact. Here, in the second state of the circuit breaker unit, the moving contact produces the electrical connection between the two fixed contacts by being in contact with both fixed contacts at the same time. If the moving contact is, owing to electromagnetic interaction with the electromagnetic drive means, moved so as to transfer the circuit breaker unit into the firs state, the contact between the moving contact and the first fixed contact is eliminated. By contrast, the contacting between the moving contact and the second fixed contact is preferably maintained even when the circuit breaker unit is in the first state.

In one embodiment of the invention, the first fixed contact likewise has a recess. The moving contact engages at least partially into the recess of the first fixed contact when the circuit breaker unit is in the second state.

Owing to the engagement of the moving contact into the recesses of the first and/or of the second fixed contact, a particularly stable configuration of the circuit breaker unit can be realized.

It is furthermore conceivable for the moving contact to engage both into the recess of the first fixed contact and into the recess of the second fixed contact when the circuit breaker unit is in the second state. During the movement of the moving contact, the latter may for example depart from the recess in the first fixed contact in order to engage correspondingly deeper into the recess of the second fixed contact. The recesses should preferably be designed such that the engagement of the moving contact into the respective recess offers a reliable electrical connection between the respective fixed contact and the moving contact.

It is advantageous if the moving contact, after the acceleration thereof, is braked by way of suitable measures in order to prevent so-called "bouncing", that is to say a—under some circumstances multiple—backward displacement of the moving contact. Said backward displacement may have the effect that a severed electrical connection between the two fixed contacts can be inadvertently restored. For this purpose, the recesses should be suitably dimensioned such that in each case one sub region of the recess can be utilized as a damping chamber.

It may furthermore be advantageous if the recess of the second fixed contact is designed for guiding the moving contact in longitudinally movable fashion. This simplifies the geometry of the arrangement and makes it possible to dispense with any additional guide means for the movement of the moving contact. The moving contact is movable within the recess along a longitudinal axis, wherein said moving contact is introduced deeper into the recess or is guided out of the recess.

In one exemplary embodiment, the moving contact is a peg-shaped pin contact. The pin contact may for example have approximately circular cylindrical geometry. It is furthermore conceivable for the recess in the second fixed contact to be of complementary shape to the pin contact, such that the recess is particularly well-suited to guiding the pin contact.

The moving contact preferably comprises a ferromagnetic core and an electronically conductive outer casing which at least partially surrounds said core. Here, it is advantageous if the outer casing exhibits high conductivity. For example, the outer casing may be manufactured from copper or aluminum. The conductivity of the outer casing is preferably greater than $10^7$ A/Vm. It is furthermore conceivable for the core to be a permanent magnet.

The lighter the moving contact, the lower the electromagnetic forces required for accelerating it. This in turn makes it possible for the size of the circuit breaker unit and the energy required for operating the electromagnetic drive means to be reduced. The weight of the moving contact is suitably between 1 g and 10 kg; a weight of between 10 g and 1 kg is particularly suitable.

In a further embodiment of the invention, the first and second fixed contacts are in the form of electrically conductive tulip contacts. The tulip-shaped fixed contacts can for example interact in a particularly effective manner with the peg-shaped pin contact in order to produce the electrical connection.

The contact arrangement preferably has a circular cylindrical geometry. Here, the moving contact and the two fixed contacts are formed with circular cylinder symmetry. The moving contact is displaceable along the cylinder axis. The recess of the second fixed contact may in this case be designed such that the moving contact can be guided by way of the recess along the cylinder axis. The diameter of the moving contact is no larger than an internal diameter of the recess.

The circuit breaker unit may furthermore comprise a housing. Here, the housing is filled with an insulating gas. The housing is preferably of gas-tight form and designed such that the contact arrangement is surrounded by the insulating gas in the contacting region between the first fixed contact and the moving contact and between the moving contact and the second fixed contact.

The insulating gas should have the greatest possible dielectric strength. The gas $SF_6$ is therefore particularly suitable as insulating gas. It is however also conceivable for some other suitable gas or gas mixture to be used, such as for example a mixture of $N_2$ and $SF_6$, wherein the weight fraction of $SF_6$ may lie between 10% and 50%. It is advantageous if the insulating gas can perform the function of an extinguishing gas for the prevention of arcs. Since the circuit breaker unit however conducts substantially only low currents when the contacts are opened in the event of a short circuit, said function of the insulating gas is not of crucial significance for the present invention.

The insulating gas is preferably situated in the housing under a pressure of 1 bar to 10 bar, particularly preferably of 7 to 9 bar.

The electromagnetic drive means may comprise a coil. Here, the coil is preferably arranged concentrically around the moving contact.

In one embodiment of the invention, the coil is arranged within the housing.

The coil may however also be arranged outside the housing.

The circuit breaker unit may furthermore also comprise two coils, wherein a first coil is assigned to the first fixed contact and a second coil is assigned to the second fixed contact.

Two physical effects may be utilized for the movement of the moving contact.

A rising current in the coil induces, by way of the magnetic field of the coil that is correspondingly built up, a circular current flow in the outer casing of the moving contact, whereby in turn, a magnetic field is generated around the moving contact, the polarity of which magnetic field is opposed to the magnetic field of the coil. This yields a resultant force (Lorentz force) on the moving contact, which causes the moving contact to be moved away from the coil. If the coil is arranged on the first fixed contact, the moving contact can be moved away from the first fixed contact in the direction of the second fixed contact, whereby the circuit breaker unit can be transferred into the first state. On the basis of this transient effect, it is possible to realize very fast switching times in the range of a few milliseconds (for example less than 10 ms). The same correspondingly applies to a decaying current in the coil. The change in current in the coil must be selected in each case correspondingly to the force to be imparted.

If a constant current flows in the coil, the moving contact, for example the ferromagnetic core of the moving contact, can be magnetized. In this case, the magnetic field of the coil and the magnetic field of the moving contact have the same polarity (reluctance effect). If the coil is arranged on the second fixed contact, the moving contact can thus be moved away from the first fixed contact in the direction of the second fixed contact. In this way, the circuit breaker unit can be transferred from the second state to the first state. In this case, the switching time is dependent on the inductivity of the coil. The coil current should be adapted to the force to be imparted, and may for example lie in the range between 10 A and 500 A, preferably between 20 A and 200 A.

If the electromagnetic drive means comprises more than one coil, both effects for the movement of the moving contact may be combined by way of suitable control of the current flow through the coils.

The circuit breaker unit with a combination of the features described above may be integrated into a direct-current hybrid switching system for medium-voltage and high-voltage installations. Here, the hybrid switching system should preferably be used with voltages in the range of greater than 1 kV, preferably greater than 70 kV.

Here, the hybrid switching system comprises a main path, which conducts operating current and comprises the mechanical circuit breaker unit, and a bypass path which is parallel to said main path and which comprises an electronic power switch. Furthermore, the hybrid switching system may also comprise auxiliary switches and other elements and further paths, which are connected for example in parallel with respect to the main path. The circuit breaker unit may in this case have one or a combination of several of the features described above.

In a further usage example, the circuit breaker unit according to the invention may be used in a direct-current voltage network (DC network) or in a multi-terminal system comprising multiple inverter installations.

In a multi-terminal system, it is often necessary in the prior art for the entire system to be separated from the network in the event of a fault, for example a short circuit, wherein the inverter installations must be shut down. Only after the fault has been eliminated can the system be restarted and set in operation again.

In this context, the circuit breaker unit may be used in order, in the event of a fault, to sever a connection between inverter installations of the system, in order to separate off that part of the system which is affected by the fault. Owing to the fast switching time of the circuit breaker unit, a breakdown of the entire system can be prevented.

At least one of the inverter installations may for example be a self-controlled high-voltage direct current transmission installation (HVDC installation). It may for example comprise a multi-stage inverter which has phase modules with series-connected sub modules, wherein the double-pole sub modules are in the form of full-bridge circuits or half-bridge circuits. In the event of a fault, the HVDC installation can switch the connection to be severed into a current less and voltage-free state, such that the circuit breaker unit can subsequently sever the connection.

BRIEF DESCRIPTION OF THE SEVERAL VIEWS OF THE DRAWING

The invention will be discussed in more detail below on the basis of FIGS. 1 to 5.

DESCRIPTION OF THE INVENTION

Figure 1:
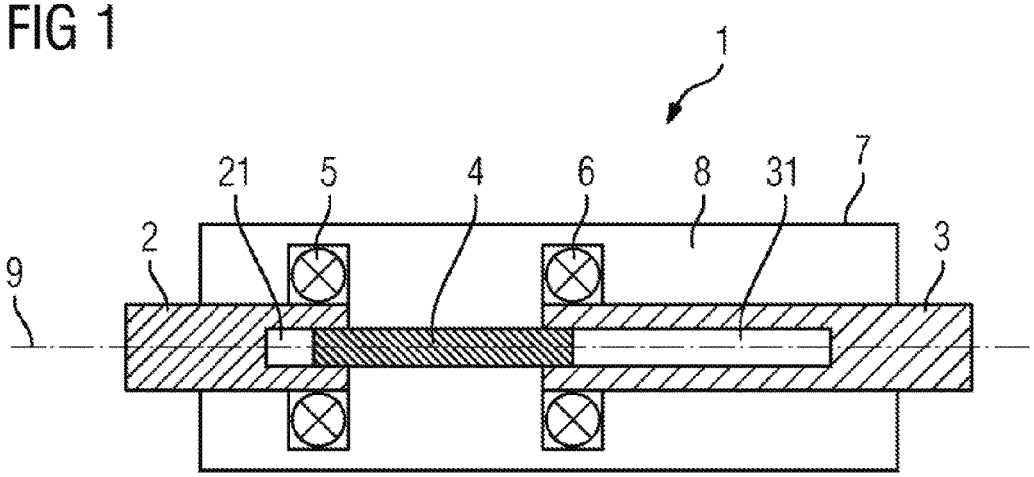
FIG. 1 shows an embodiment of a circuit breaker unit according to the invention in a schematic cross-sectional illustration.

In detail, FIG. 1 illustrates a schematic cross section through a mechanical circuit breaker unit 1 according to the invention. The circuit breaker unit 1 comprises a contact arrangement which has a first fixed contact 2, a second fixed contact 3 and a moving contact 4. Furthermore, the circuit breaker unit 1 comprises an electromagnetic drive means which has two coils 5, 6.

The circuit breaker unit 1 is connected by way of the two fixed contacts 2, 3 to a power path of a switching system.

In the exemplary embodiment shown in FIG. 1, the circuit breaker unit 1 exhibits cylindrical symmetry. The moving contact 4 is accordingly in the form of a peg-shaped pin contact. The fixed contacts 2, 3 are in the form of tulip contacts with (circular) cylinder symmetry. The coils 5, 6 are each of ring-shaped form, and are positioned concentrically around the fixed contacts 2, 3, wherein the coil 5 is assigned to the first fixed contact 2, and the coil 6 is assigned to the second fixed contact 3. The axes of symmetry of the circuit breaker unit 1 is indicated by the line 9.

The first fixed contact 2 has a recess 21. The dimensions of the recess 21 are such that a sub region of the recess 21 can serve as damping chamber.

The second fixed contact 3 likewise has a recess 31.

FIG. 1 shows the circuit breaker unit 1 in a second state, in which an electrical connection is produced between the first fixed contact 2 and the second fixed contact 3. In the position illustrated in FIG. 1, the moving contact 4 engages both into the recess 21 and into the recess 31. Here, the surface of the moving contact 4 and the surface of the first fixed contact 2, and the surface of the moving contact 4 and the surface of the second fixed contact 3, make contact with one another in order to produce the electrical connection. It is however likewise conceivable for the contacting to be produced indirectly by way of an electrically conductive intermediate material arranged between the moving contact and the respective fixed contact. An intermediate material of said type is for example an electrically conductive lubricant.

The entire region in which the contacting takes place is enclosed in gas-tight fashion by a housing 7. The housing is filled, in the interior 8 thereof, with an insulating gas. In the exemplary embodiment shown in FIG. 1, the insulating gas is $SF_6$.

A current flow in the coil 6 generates a magnetic field which, owing to the resulting reluctance force on the moving contact, effects the movement thereof in the direction of the second fixed contact 3. The moving contact 4 thus engages deeper into the recess 31, wherein the contact between the moving contact 4 and the first fixed contact 2 is severed. The circuit breaker unit 1 is thus moved into the first state, in which there is no electrical connection between the two fixed contacts 2, 3.

In order to move the moving contact 4 (partially) out of the recess 31 again, a current flow is generated in the coil 5 (with no current being conducted by the coil 6), whereby the corresponding reluctance force effects a movement of the moving contact 4 in the direction of the coil 5, wherein the moving contact 4 engages into the recess 21 in the first fixed contact 2 and effects contacting between the first fixed contact 2 and the moving contact 4. Here, the length of the moving contact 4 is dimensioned such that the moving contact 4 can, in one end position (which substantially corresponds to the position of the moving contact illustrated in FIG. 1), produce the electrical connection between the two fixed contacts 2, 3, such that the circuit breaker unit 1 is situated in the second state.

A rising current flow in the coil 5 can, with utilization of the Lorentz force, effect the movement of the moving contact 4 in the direction of the second fixed contact 3, wherein the circuit breaker unit 1 can be transferred from the second state into the first state. A corresponding current increase in the coil 6 can effect a movement of the moving contact 4 back into the position shown in FIG. 1.

In the exemplary embodiment of FIG. 1, the coils 5, 6 are arranged within the housing 7. The supply lines (not illustrated) to the coils 5, 6 are accordingly equipped with gas-tight leadthroughs (not illustrated).

Figure 2:
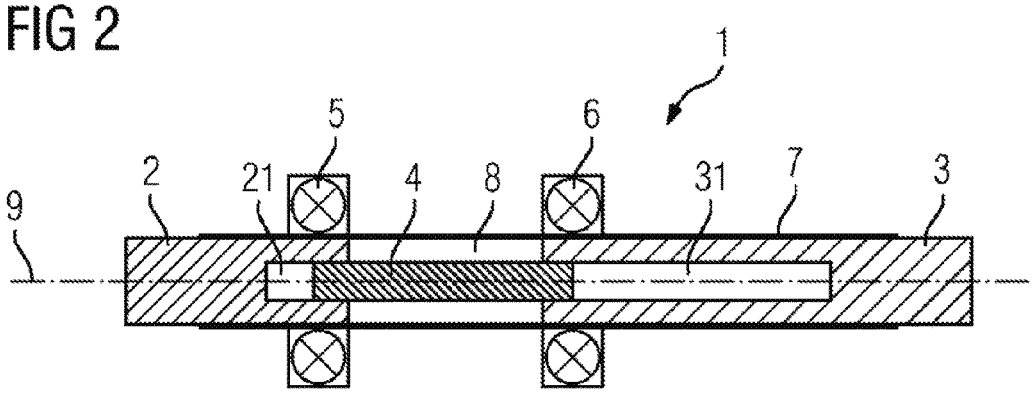
FIG. 2 shows a further embodiment of the circuit breaker unit according to the invention in a schematic cross-sectional illustration.

FIG. 2 shows a further exemplary embodiment of a circuit breaker unit 1 according to the invention in a schematic illustration.

Figure 3:
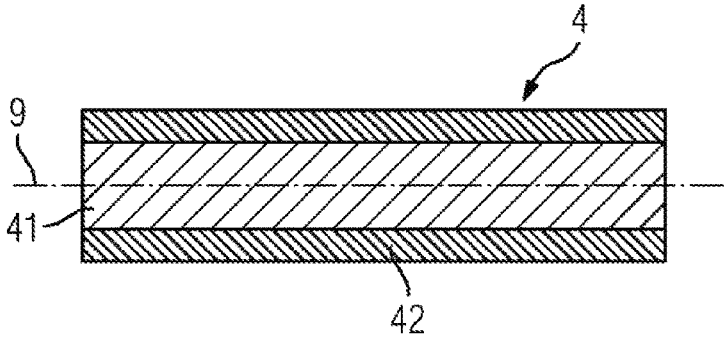
FIG. 3 shows an embodiment of a moving contact in a schematic cross-sectional illustration.
Figure 4:
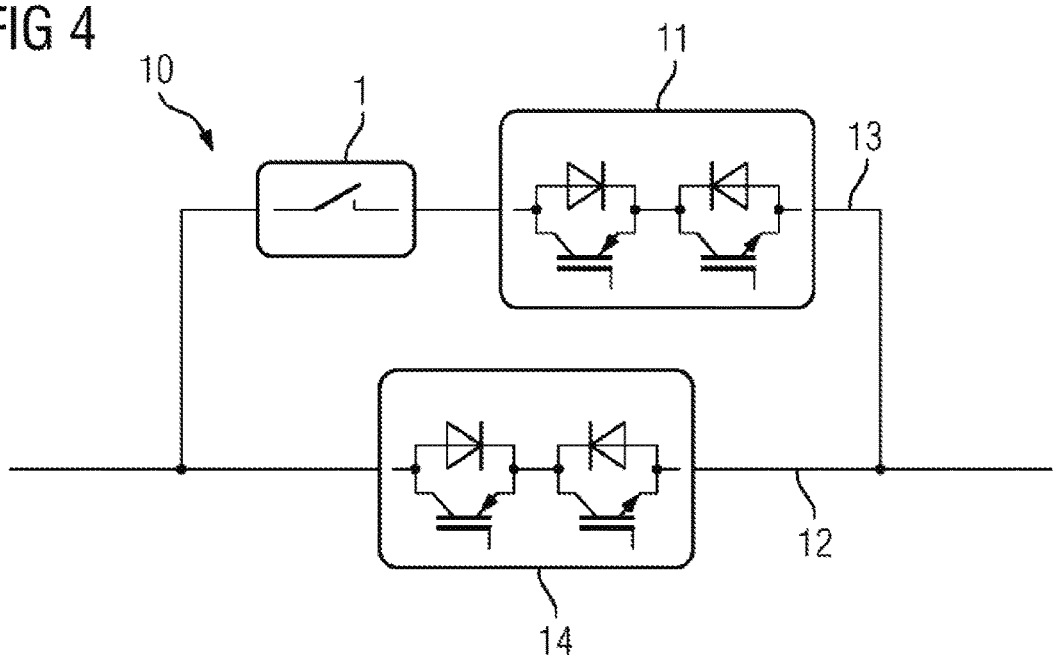
FIG. 4 shows a first usage example of the circuit breaker unit according to the invention in a schematic illustration.

Identical and similar parts are denoted by the same reference numerals in FIGS. 1 and 2, and this also applies to the further FIGS. 3 and 4. To avoid repetitions, only the differences in relation to the embodiment of FIG. 1 will be discussed in detail in the description of the embodiment of FIG. 2.

The exemplary embodiment of FIG. 2 corresponds substantially to the exemplary embodiment of FIG. 1, with the difference that the cylindrical-shaped housing 7 has a smaller diameter. The coils 5, 6 are accordingly arranged outside the housing 7. In this exemplary embodiment, it is thus possible to dispense with gas-tight leadthroughs of the supply lines to the coils 5, 6.

FIG. 3 shows an exemplary embodiment of the moving contact 4 in a schematic cross-sectional illustration. The moving contact 4 has a geometry with (circular) cylinder symmetry, wherein the axis of symmetry is indicated by the line 9.

The moving contact 4 comprises a ferromagnetic core 41 composed of iron, and an outer casing 42 composed of aluminum, which exhibits good conductivity. Here, the ferromagnetic core 41 has the function of building up and/or intensifying the magnetic field of the moving contact 4, which magnetic field interacts with the magnetic field of the coils 5, 6.

The diameter, shown in FIG. 3, of the core 41 may be varied (in relation to the diameter of the moving contact 4) in a manner dependent on the usage situation.

FIG. 4 shows a usage example of the circuit breaker unit 1 in a schematic illustration. FIG. 4 illustrates a hybrid switching system 10, wherein the hybrid switching system 10 comprises the circuit breaker unit 1.

The hybrid switching system 10 has a main path 12 and a bypass path 13. The main path 12 and the bypass path 13 are connected in parallel with respect to one another. The main path 12 comprises the circuit breaker unit 1 and an auxiliary switch 11. The bypass path 13 comprises a power switch 14.

The auxiliary switch 11 comprises a number of electronic switches, which are in the form of IGBT modules.

The power switch 14 comprises a multiplicity of electronic switches which are connected in series and which are in the form of IGBT modules. The multiplicity of electronic switches of the power switch 14 is several times greater than the number of electronic switches of the auxiliary switch 11. For example, the auxiliary switch 11 may have two IGBT modules, whereas the power switch 14 may comprise up to several hundred IGBT modules.

During the normal operation of an installation into which the hybrid switching system 10 is integrated, the operating current flows substantially via the main path 12, because the resistance of the power switch 14 is very much greater than the resistance of the circuit breaker unit 1 and of the auxiliary switch 11.

In the event of a short circuit, the current in the main path increases initially approximately exponentially. The auxiliary switch 11 is, for this purpose, designed to disconnect with the least possible time delay, preferably in the range of microseconds, in such a situation, whereby the current that rises further is commutated into the bypass path 13. The circuit breaker unit 1 is then transferred into the first state, such that the auxiliary switch 11 is not damaged by the high applied voltage (of up to several hundred kilovolts).

The current that is commutated into the bypass path can subsequently be limited by way of the power switch 14.

Depending on the arrangement of the electronic switches in the power switch 14 and in the auxiliary switch 11, the hybrid switching system 10 may be formed as a unidirectional or bidirectional switch. In the exemplary embodiment of FIG. 4, the hybrid switching system 10 is designed as a bidirectional switch, as is graphically indicated by way of corresponding symbols.

Figure 5:
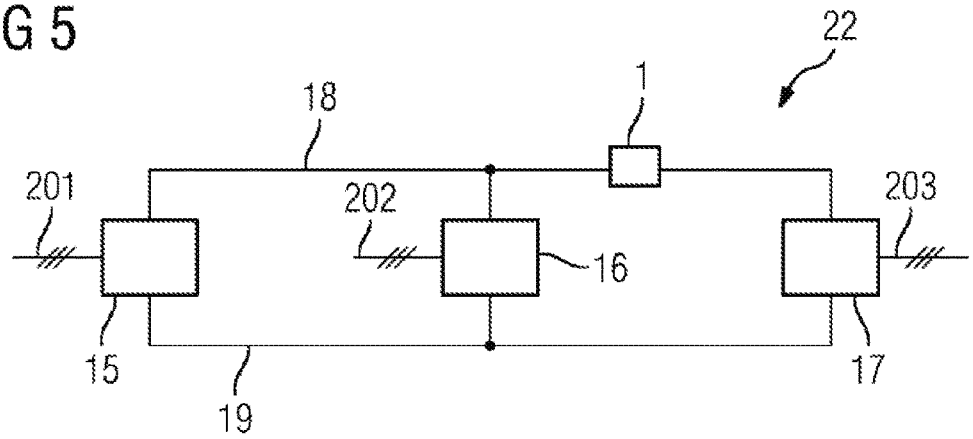
FIG. 5 shows a second usage example of the circuit breaker unit according to the invention in a schematic illustration.

FIG. 5 shows a simple example of a multi-terminal system 22 with three inverter stations 15, 16, 17, which are in the form of self-controlled multi-stage inverters.

The inverter station 15 is connected to a three-phase alternating-current voltage network 201, which is not illustrated in any more detail in FIG. 5. The inverter stations 16 and 17 are likewise connected to alternating-current voltage networks 202 and 203 respectively.

At the direct-current voltage side, the inverter stations 15, 16, 17 are connected to one another via the two direct-current lines 18 and 19, which are of different polarity.

The energy provided in the alternating-current voltage network 201 is converted, in the inverter station 15, into direct-current voltage. By way of direct-current lines 18, 19, the energy is transported from the inverter station 15 to the two inverter stations 16, 17, where the energy is converted into alternating current again and fed into the alternating-current voltage networks 202 and 203. The circuit breaker unit 1 is arranged in the direct-current line 18.

If a fault occurs for example at the inverter station 17, the direct-current voltage line is connected into a voltage-free and current less state, such that the circuit breaker unit 1 can be transferred into its opening (first) state. The direct-current line 18 can thus be interrupted, and the faulty inverter station 17 separated from the intact part of the system. Subsequently, the intact part of the system, which comprises the inverter stations 15, 16, can be set in operation again. The entire process can be completed in less than 300 ms, such that a possible outage of the energy to be provided by the system can be minimized in terms of time.

It is self-evidently possible for the circuit breaker unit according to the invention to also be used in relatively large systems and DC networks with a greater number of inverter stations. The use of said circuit breaker unit according to the invention may be particularly advantageous for example in intermeshed DC networks.

LIST OF REFERENCE NUMERALS

1 Circuit breaker unit
2 First fixed contact
21 Recess
3 Second fixed contact
31 Recess
4 Moving contact
41 Core
42 External casing
5, 6 Coil
7 Housing
8 Housing interior
9 Line
10 Hybrid switching system
11 Auxiliary switch
12 Main path
13 Bypass path
14 Power switch
15, 16, 17 HVDC installation
18, 19 Direct-current line
201, 202, 203 Alternating-current voltage network
22 Multi-terminal system

The invention claimed is:

1. A circuit breaker unit for interrupting an electrical line, the circuit breaker unit comprising:

a contact arrangement with a first fixed contact, a second fixed contact, and a movably mounted, guided moving contact;

an electromagnetic drive for moving said moving contact;

the circuit breaker unit having a first state wherein no electrical connection exists between said first and second fixed contacts;

the circuit breaker unit having a second state wherein said moving contact electrically connects said first and second fixed contacts to one another; and wherein the circuit breaker unit is transferable from the second state into the first state by movement of said moving contact;

said second fixed contact having a recess formed therein for receiving said moving contact, and said moving contact protruding at least partially into said recess when the circuit breaker unit is in the first state.

2. The circuit breaker unit according to claim 1, wherein said first fixed contact has a recess formed therein for receiving said moving contact, and said moving contact protrudes at least partially into said recess of said first fixed contact when the circuit breaker unit is in the second state.

3. The circuit breaker unit according to claim 1, wherein the recess formed in said second fixed contact is configured for guiding said moving contact in longitudinal moving direction.

4. The circuit breaker unit according to claim 1, wherein said moving contact is a peg-shaped pin contact.

5. The circuit breaker unit according to claim 1, wherein said moving contact has a ferromagnetic core and a conductive outer casing.

6. The circuit breaker unit according to claim 1, wherein said moving contact has a weight between 1 g and 10 kg.

7. The circuit breaker unit according to claim 1, wherein each of said first and second fixed contacts is in a form of an electrically conductive tulip.

8. The circuit breaker unit according to claim 1, wherein said moving contact and said first and second fixed contacts are formed with circular cylinder symmetry, and said moving contact is displaceable along a cylinder axis of said moving contact.

9. The circuit breaker unit according to claim 1, which further comprises a housing filled with insulating gas.

10. The circuit breaker unit according to claim 9, wherein said insulating gas in said housing has a pressure of 1 bar to 10 bar.

11. The circuit breaker unit according to claim 9, wherein said electromagnetic drive comprises a coil disposed within said housing and arranged concentrically around said moving contact.

12. The circuit breaker unit according to claim 9, wherein said electromagnetic drive comprises a coil disposed outside said housing and arranged concentrically around said moving contact.

13. The circuit breaker unit according to claim 1, wherein said electromagnetic drive comprises a coil disposed concentrically around said moving contact.

* * * * *